United States Patent [19]

Figueras

[11] 3,950,239

[45] Apr. 13, 1976

[54] ELECTRICAL CONNECTOR FOR BIPOLAR ELECTRODES

[75] Inventor: Wilfredo E. Figueras, Amherst, N.Y.

[73] Assignee: Hooker Chemicals & Plastics Corporation, Niagara Falls, N.Y.

[22] Filed: July 24, 1974

[21] Appl. No.: 491,191

[52] U.S. Cl. ..... 204/254; 204/268; 204/283; 204/284; 204/286

[51] Int. Cl.[2] ..... C25C 7/00; C25C 7/02

[58] Field of Search ..... 204/254, 255, 256, 268, 204/283, 284, 286

[56] References Cited

UNITED STATES PATENTS

| | | | |
|---|---|---|---|
| 1,502,708 | 7/1924 | Allan | 204/286 X |
| 3,788,966 | 1/1974 | Stephenson et al. | 204/254 X |
| 3,824,173 | 7/1974 | Bouy et al. | 204/254 X |
| 3,849,279 | 11/1974 | Barkel | 204/254 |

FOREIGN PATENTS OR APPLICATIONS

| | | | |
|---|---|---|---|
| 243,329 | 12/1946 | Switzerland | 204/254 |

*Primary Examiner*—Howard S. Williams
*Assistant Examiner*—A. C. Prescott
*Attorney, Agent, or Firm*—Peter F. Casella; Herbert W. Mylius

[57] ABSTRACT

An improved bipolar type electrolytic filter press cell for the electrolytic decomposition of ionizable chemical compounds is provided which comprises a cell housing containing a plurality of cell units made up of anode compartments each containing a bipolar anode element and cathode compartments each containing a bipolar cathode element, each of said anode compartments being maintained in spaced relationship with the cathode compartment of the adjoining cell unit by an electrically inactive cell separator which prevents electrolyte and gas flow from one cell unit to the adjoining cell unit, and means for transferring electrical energy from an anode element to the cathode element of the adjoining cell unit, said means comprising 1. An electrically conductive hollow cylinder member capped on one end and fixedly attached to and in electrical contact with said anode element at said capped end, said cylinder member extending from said anode element to said cell separator, 2. An electroconductive rod extending from said cathode element through said cell separator into said cylinder member and in electrical contact with said cylinder member, and 3. Means for preventing electrolyte and gas leakage through said cell separator at the point where said electroconductive rod passes through said cell separator.

4 Claims, 1 Drawing Figure

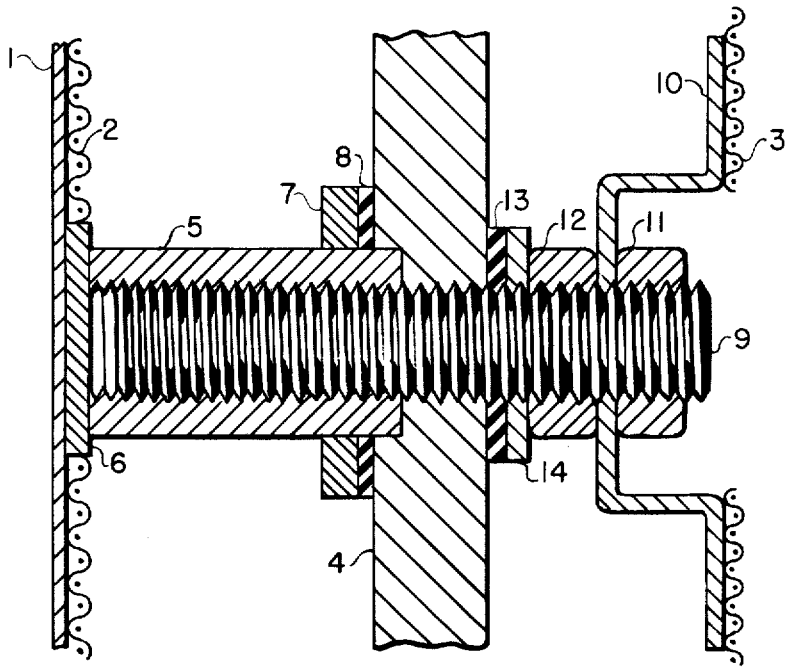
1
2
8
7
5
13
12
11
10
3
9
6
14
4

ELECTRICAL CONNECTOR FOR BIPOLAR ELECTRODES

FIELD OF THE INVENTION

This invention relates to electrolytic cells and more particularly to electrolytic cells containing a bipolar type electrode wherein the electrical energy is transferred from the anode element to the cathode element of the bipolar electrode within the cell in a fluid tight manner.

BACKGROUND OF THE INVENTION

The electrolysis of ionizable chemical compounds, e.g., alkali metal halides, to yield useful products, e.g., alkali metal hydroxides, hydrogen and the elemental halogen has long been practiced commercially. The electrolysis has been carried out in diaphragm cells wherein there are two compartments separated by a porous diaphragm. One compartments contains the cathode and the other contains the anode, the electrolyte flowing from the anode compartment through the porous diaphragm into the cathode compartment completing the electrical circuit. A variant of such a two-compartment cell, i.e., the filter press arrangement, wherein a number of cells are connected in series in a common housing. In such a variant, the anode of one cell is connected electrically with the cathode of an adjacent cell, said cells being separated by a barrier serving to prevent the passage of electrolyte between the adjacent cells. Such a configuration is termed a "bipolar electrode" and the series of cells is called a "bipolar type filter press cell."

The provision of efficient electrical connections between the anode and cathode elements of adjacent cell units which are both compact and liquid and gas tight is an important and often troublesome problem in the design and fabrication of bipolar type filter press cells. In some cells, the electrical connection is accomplished by external wiring which is not only expensive in the amount of metal required but also relatively difficult to maintain in leakproof condition. In other installations, as disclosed for example in U.S. Pat. No. 3,242,059, expensive titanium is used as both the individual cell divider and electrical connector. In U.S. Pat. No. 3,752,757, there is provided a bipolar electrode unit, including a plastic barrier sheet separating the adjacent cell units. The anode and cathode units are connected though bosses attached to the electrodes and maintained in axial alignment by means of a bolt extending through said bosses. The sealing of the cell is accomplished by O-rings set in chambers cut in each of the bosses. Such a design wherein dissimilar metals are placed in contact with each other requires careful fabrication and due to differences in the coefficient of expansion are difficult to maintain in fluid-tight condition during extended use. Accordingly, it can be seen that available electrical connectors for bipolar electrodes currently available leave something to be desired.

BRIEF SUMMARY OF THE INVENTION

In accordance with the present invention, a bipolar type electrolytic filter press cell for the electrolytic decomposition of ionizable chemical compounds is to provide which comprises a cell housing containing a plurality of cell units each of which has an anode compartment containing a bipolar anode element and a cathode compartment containing a bipolar cathode element, each of said anode compartments being maintained in spaced relationship with the cathode compartment of the adjoining cell unit by an electrically inactive cell separator which prevents electrolyte and gas flow from one cell unit to the adjoining cell unit, and means for transferring electrical energy from the anode elements to the cathode element of the adjoining cell unit, said means comprising 1. a electroconductive hollow cylinder member having a cap on one end and fixedly attached to said anode element at said capped end, said hollow rod member extending from said anode element to, and preferably into, said cell separator, 2. an electroconductive rod extending from said cathode element through said cell separator into said cylinder member and making electrical contact with said anode element, and 3. means, e.g., gaskets and/or washers, for preventing electrolyte and gas leakage through said cell separator at the point where said electroconductive rod passes into and through said cell separator.

DETAILED DESCRIPTION OF THE INVENTION

The present invention is directed to an electrolytic cell suitable for the electrolysis of ionizable chemical compounds, particularly alkali metal halide brines and hydrohalic acids comprising a cell body, including at least one bipolar electrode, the anode element and the cathode element of said bipolar electrode being separated by an electrically inactive, i.e., a nonconductive cell separator, said anode and said cathode elements being connected electrically by an internal connector which passes through said cell separator in a fluid-tight fashion. The connector comprises an electroconductive metal rod extending from said cathode element through said cell separator into an electrically conductive hollow cylinder which is cappped at one end and fixedly attached at said capped end and in electrical contact to said anode element. The capped cylinder member extends to, and preferably into, said cell separator. The electroconductive rod is positioned to be in electrical contact with said cylinder, which, in turn, is in electrical contact with said anode element, thereby completing an electrical circuit between said anode and cathode elements. The cylinder is preferably provided with a means to prevent fluid leakage from the anode compartment through the cell separator, and gaskets and/or washers may be provided at the points of passage of the rods into and through the cell separator.

The present connector also provides a means of securing the anode elements and cathode elements within an electrolytic cell in spaced relationship that may be closely controlled within very narrow tolerances.

In order that the invention may be readily understood, it will be described with reference to certain preferred embodiments. The invention, however, is not limited to such embodiments since equivalent elements as indicated hereinafter can be utilized in accordance with this invention also.

In the drawing attached hereto and forming a part hereof is a partial schematic representation of a bipolar electrolysis cell containing a connector of the present invention.

Referring to the drawing, there is shown a schematic partial representation of a bipolar electrolytic cell in which a portion of one bipolar cell unit is shown. In this view, a foraminous anode element, 2, shown having emplaced thereon a cation active permselective membrane, 1, is connected electrically to the cathode element, 3, of an adjacent cell unit by a connector in accord with the present invention. The connector comprises electroconductive, hollow cylinder member, 5, having a cap, 6, on one end, and electroconductive rod, 9. The juncture of cap, 6, and cylinder, 5, is gas and fluid tight. As shown in the drawing, the capped cylinder member is equipped with a collar, 7. Cylinder member, 5, is fixedly attached to and in electrical contact with anode element, 1, at a face of cap, 6, e.g., by welding, and extends into cell separator, 4. Cylinder member, 5, may suitably be fabricated of titanium-clad copper tubing. As shown in the drawing, cell separator, 4, is recessed to receive the uncapped end of cylinder member, 5. Collar, 6, on cylinder, 5, provides means by which a liquid-tight contact between the separator and the cylinder member may be obtained. Optionally, a gasket, 8, may be included to assist the fluid sealing between the collar of the cylinder member and the cell separator. The cathode element, 3, which is suitably fabricated from steel screen, has attached thereto a steel or other metal cup, 10, which is shown in cross-section, and has an aperture to receive the electroconductive metal rod, 9. As it is shown in the drawing, rod, 9, is threaded at both ends and extends into the cylinder, 5, which is threaded to receive the stud and through cap, 6, makes electrical contact with the anode element, 1. Alternatively, rod, 9, can be sweated into the cylinder, 5. Rod, 9, is fixed to cathode, 3, through a cup, 10, by jam nuts, 11 and 12, which serve to hold the rod, 9, firmly in place. Gasket, 13, and washer, 14, serve to seal the passage in cell separator, 4, through which the rod, 9, passes when jam nut, 12, is tightened. Thus, a fluid-tight mechanical seal which is also an efficient electrical connection between the anode and cathode elements is obtained. The arrangement also allows adjustment to critical tolerances of the spacing between the anode and cathode members.

The electrodes forming the elements of the present bipolar electrode may be formed of any electrically conductive metal which will resist the corrosive attack of the various cell reactants and products with which they may come in contact, such as alkali metal hydroxides, hydrochloric acid, chlorine and the like. Typically, the cathode elements may be constructed of iron, steel and the like, with steel being generally preferred. Similarly, the anodes may be formed of metal or metal alloys. Typically, the anode elements are formed of a so-called "valve" metal, such as titanium, tantalum or niobium as well as alloys of these in which the valve metal constitutes at least about 90% of the alloys. The surface of the valve metal may be made active by means of a coating of one or more noble metals, noble metal alloys, noble metal oxides, or mixtures of such oxides alone or with oxides of other metals. The noble metals which may be used include ruthenium, rhodium, palladium, iridium, and platinum. Particularly preferred metal anodes are those formed of titanium having a mixed titanium oxide and ruthenium coating on the surface, as is described in U.S. Pat. No. 3,632,498. The valve metal substrate may be clad on a more electrically conductive metal core, such as aluminum, steel, copper, or the like. While it is preferred that the cathode element should be made of a foraminous or porous, e.g., screen, material, solid steel place can be used. The anode element, however, should preferably be fabricated from foraminous or porous material.

The materials of construction for the electrical connector of this invention should be such as to resist corrosive attack of the various cell reactants and products which they may come in contact. The portion of the electroconductive cylinder member that is exposed to the inner cell environment is suitably constructed of a material that is substantially unaffected by the conditions existing in the cell when the cell is operational. The cylinder member may be constructed of a valve metal of a similar composition as is used for the anode member to which it is attached, or the exposed surface of the cylinder member may be coated with a non-reactive metal, such as titanium, or with a non-reactive resin material such as polytetrafluoroethylene. The electroconductive rod should be of a metal such as copper, steel, aluminum, and the like. Particularly preferred metals are titanium-clad copper for the cylinder member and copper for the electroconductive rod. The jam nuts used to position and hold in place the electroconductive rod are typically constructed of steel. Gaskets where used to assist in sealing the connector elements to the cell separator may be of neoprene rubber or asbestos and washers are typically of steel or iron.

The cell separators used to separate the several cell units and to isolate the anode and cathode elements of the bipolar electrode are fabricated, preferably from a synthetic resin material which is resistant to the cell reactants and products. Typically such resins as polypropylene, polyethylene and polybutylene, polyvinyl acetate, polyesters, and the like, are used. Such resins may suitably contain filler materials such as asbestos. Alternatively, valve metals can be used but for reasons of economy and ease of fabrication, such metals are less preferred.

The anode and cathode compartments of the individual cells units may be separated from each other by means of a diaphragm barrier or membrane. The diaphragm may be omitted and in such case, the electrolysis cells produce sodium chlorate by the electrolysis of sodium chloride brine in the known manner. In the conventional cell used for the electrolysis of alkali metal halide brines to produce chlorine in the anode compartment and alkali metal hydroxide in the cathode compartment, a porous diaphragm is used. Typically, such a porous diaphragm is an asbestos diaphragm suspended by the foraminous cathode. Recently it has been proposed to replace this porous diaphragm with a cation active permselective membrane which is substantially impervious to liquids and gases. Preferably, this membrane is positioned on the front face of the anode. Electrolysis cells comprising such a membrane on the front face of the porous anode are disclosed in U.S. application of Tokowa et al., Ser. No. 416,916, filed Nov. 19, 1973, the disclosure of which is incorporated herein by reference.

Thus in a preferred embodiment these compartments are separated from each other by a membrane which is substantially impervious to fluids and gases and composed essentially of a hydrolyzed copolymer of a perfluorinated hydrocarbon and a fluorosulfonated perfluorovinyl ether. The perfluorinated hydrocarbon is preferably tetrafluoroethylene, although other perfluorinated and saturated and unsaturated hydrocarbons of 2 to 5 carbon atoms may also be utilized, of which the monoolefinic hydrocarbons are preferred, especially those of 2 to 4 carbon atoms and most especially those of 2 to 3 carbon atoms, e.g., tetrafluoroethylene, hexafluoropropylene. The sulfonated perfluorovinyl ether which is most useful is that of the formula $FSO_2CF_2CF_2OCF(CF_3)CF_2OCF{=}CF_2$. Such a material, named as perfluoro[2(2-fluorosulfonylethoxy)-propyl vinyl ether], referred to henceforth as PSEPVE, may be modified to equivalent monomers, as by modifying the internal perfluorosulfonylethoxy component to the corresponding propoxy component and by altering the propyl to ethyl or butyl, plus rearranging positions of substitution of the sulfonyl thereon and utilizing isomers of the perfluoro-lower alkyl groups, respectively. However, it is most preferred to employ PSEPVE.

It is to be understood that although the invention has been described with specific reference to a particular embodiment thereof, it is not to be so limited since changes and alterations therein may be made which are within the intended scope of the invention.

What is claimed is:

1. A bipolar electrolytic filter press cell for the electrolytic decomposition of ionizable chemical compounds which comprises a cell housing containing a plurality of cell units made up of anode compartments each containing a bipolar cathode element, said compartments being separated within the cell housing by a membrane member, each anode compartment being maintained in spaced relationship with the cathode compartment of the adjoining cell unit by an electrically inactive cell separator which prevents electrolyte and gas flow from one cell unit to the adjoining cell unit, and means for transferring electrical energy from the anode element to the cathode element of the adjoining cell unit, said means comprising 1. an electroconductive cylinder member, having a cap on one end, fixedly attached to, and in electrical contact with, said anode element at said capped end and extending from said anode element to said cell separator,
2. said cylinder member having a collar positioned around the periphery thereof, said collar being positioned contiguous to said cell separator,
3. a gasket member positioned between said collar and said cell separator preventing electrolyte and gas leakage through said cell separator,
4. an electroconductive rod extending through said cell separator one end of said rod adjustably engaged, and in electrical contact with, the inside of said cylinder member,
5. the other end of said rod being mechanically attached, and in electrical contact with said cathode member.

2. A bipolar cell as described in claim 1 wherein said rod member is threaded and said cylinder member is threaded internally to receive said rod member.

3. A bipolar cell as described in claim 1 wherein said cell separator is recessed to partially receive said cylinder member therein.

4. A bipolar cell as described in claim 1 wherein said rod is secured to, and held in electrical contact with, said cathode element by one or more nut members threadably engaged on said rod.

* * * * *